US011208223B2

(12) United States Patent
Schüttfort

(10) Patent No.: US 11,208,223 B2
(45) Date of Patent: Dec. 28, 2021

(54) PACKAGING APPARATUS FOR SMALL PIECE GOODS AND METHOD FOR PRODUCING A BLISTER TUBE COMPRISING A PLURALITY OF BLISTER BAGS

(71) Applicant: Becton Dickinson Rowa Germany GmbH, Kelberg (DE)

(72) Inventor: Torben Schüttfort, Sassen (DE)

(73) Assignee: BECTON DICKINSON ROWA GERMANY GMBH, San Diego, CA (US)

( * ) Notice: Subject to any disclaimer, the term of this patent is extended or adjusted under 35 U.S.C. 154(b) by 0 days.

(21) Appl. No.: 16/879,464

(22) Filed: May 20, 2020

(65) Prior Publication Data

US 2021/0362888 A1 Nov. 25, 2021

(51) Int. Cl.
*B65B 9/20* (2012.01)
*B65B 61/00* (2006.01)
(Continued)

(52) U.S. Cl.
CPC ..... *B65B 9/2042* (2013.01); *B65B 9/20* (2013.01); *B65B 9/2035* (2013.01); *B65B 9/213* (2013.01);
(Continued)

(58) Field of Classification Search
CPC ..... B65B 9/20; B65B 9/2035; B65B 9/2042; B65B 9/213; B65B 51/303; B65B 61/007;
(Continued)

(56) References Cited

U.S. PATENT DOCUMENTS 2,200,971 A 5/1940 Sonneborn et al.
2,272,530 A * 2/1942 Patterson ..... B65B 9/06 53/451
(Continued)

FOREIGN PATENT DOCUMENTS

DE 202008003929 U1 5/2008
EP 1740466 A1 1/2007
(Continued)

OTHER PUBLICATIONS

Extended European Search Report for Application No. 20175582.4, dated Nov. 11, 2020, 13 pages.

*Primary Examiner* — Stephen F. Gerrity
(74) *Attorney, Agent, or Firm* — Morgan, Lewis & Bockius LLP

(57) ABSTRACT

A packaging apparatus for small piece goods, the use of the packaging apparatus, and a method for producing a blister tube are provided. The packaging apparatus includes a packaging material guiding device for providing a shaped packaging material web suitable for receiving small piece goods, a longitudinal joining device which is arranged downstream of the packaging material guiding device and a transverse joining device which is arranged downstream of the packaging material guiding device. The transverse joining device joins the shaped packaging material web together at predetermined intervals transversely to the direction of travel to form a transverse joining area. The transverse joining device includes two joiners, which have a plurality of embossers that are individually movable transversely to the direction of travel and have an embosser stop area which cooperate such that elevations that are palpable are formed by the embossers in the transverse joining area.

20 Claims, 6 Drawing Sheets

(51) Int. Cl.

| | |
|---|---|
| ***B65B 61/02*** | (2006.01) |
| ***B65B 51/30*** | (2006.01) |
| ***B65B 61/26*** | (2006.01) |
| ***B65B 9/213*** | (2012.01) |
| ***B65B 61/06*** | (2006.01) |

(52) U.S. Cl.
CPC ..... *B65B 51/303* (2013.01); *B65B 61/007* (2013.01); *B65B 61/025* (2013.01); *B65B 61/06* (2013.01); *B65B 61/26* (2013.01)

(58) Field of Classification Search
CPC ..... B65B 61/02; B65B 61/025; B65B 61/06; B65B 61/26; B41F 17/24
USPC ..... 53/411, 131.2, 131.4
See application file for complete search history.

(56) References Cited

U.S. PATENT DOCUMENTS 3,273,310 A * 9/1966 Freeman ..... B65B 7/14 53/131.2
3,293,824 A * 12/1966 Dorr ..... B65B 61/025 53/131.2
3,473,286 A * 10/1969 Henry ..... B65B 61/025 53/411
4,018,029 A 4/1977 Safranski et al.
4,227,614 A * 10/1980 Hollander, Jr. .... B65D 75/5822 206/219
4,387,547 A * 6/1983 Reil ..... B65B 9/213 53/131.5
6,250,543 B1 * 6/2001 Saijo et al. ..... B65B 51/144 53/376.6
2007/0169878 A1 * 7/2007 Tucker et al. ..... B65B 9/02 156/220
2007/0209322 A1 * 9/2007 Betti et al. ..... B65B 61/025 53/251
2009/0094945 A1 * 4/2009 Nakagawa et al. ... B65B 61/025 53/451
2012/0012490 A1 * 1/2012 Brownell ..... B65B 61/025 206/459.5

FOREIGN PATENT DOCUMENTS

JP 11292091 A * 10/1999 ..... B65B 9/06
JP 2003291910 A 10/2003
WO WO-2013034504 A1 * 3/2013 ..... B65B 9/06
WO WO-2016113291 A1 * 7/2016 ..... B65B 61/025
WO WO-2018184795 A1 * 10/2018 ..... B65B 9/22

* cited by examiner

PACKAGING APPARATUS FOR SMALL PIECE GOODS AND METHOD FOR PRODUCING A BLISTER TUBE COMPRISING A PLURALITY OF BLISTER BAGS

BACKGROUND

The present disclosure relates to a packaging apparatus for small piece goods, in particular medicament portions and food supplement portions, the use of the packaging apparatus, and a method for producing a blister tube comprising a plurality of blister bags.

SUMMARY

One or more embodiments include a packaging apparatus for small piece goods. The packaging apparatus includes a packaging material guiding device for receiving an elongated packaging material web, wherein the packaging material guiding device is configured such that the elongated packaging material web is shaped to be suitable for receiving small piece goods and wherein the elongated packaging material web shape continues in a direction of travel. The packaging apparatus also includes a longitudinal joining device arranged downstream of the packaging material guiding device and configured to join the shaped packaging material web together at a packaging material overlap area in the direction of travel of the shaped packaging material web. The packaging apparatus further includes a transverse joining device which is arranged downstream of the packaging material guiding device and configured to join the shaped packaging material web together at predetermined intervals transversely to the direction of travel to form a transverse joining area, wherein the transverse joining device comprises two joiners, wherein at least one joiner is movable transversely to the direction of travel. The packaging apparatus also includes a plurality of embossers that are individually moveable transversely to the direction of travel and an embosser stop area, wherein the plurality of embossers and the embosser stop area cooperate to form elevations that are palpable in the transverse joining area.

One or more embodiments include a method for producing a blister tube comprising a plurality of blister bags. The method includes providing a packaging material web in a direction of travel and shaping, in the direction of travel, the packaging material web into a shaped packaging material web having a receiving area for medicament portions. The method also includes feeding small piece goods to the receiving area and joining, by a longitudinal joining device, the shaped packaging material web together to form a tubular packaging material web at a packaging material overlap area in the direction of travel of the shaped packaging material web. The method further includes joining, by a transverse joining device, the tubular packaging material web together in a transverse joining area at predetermined intervals, based on the direction of travel and embossing a palpable pattern in the transverse joining area by a plurality of embossers movable transversely to the direction of travel.

One or more embodiments include a packaging apparatus. The packaging apparatus includes a packaging material guiding device configured to shape a moving elongated packaging material web into a shaped packaging material web. The packaging apparatus also includes a longitudinal joining device configured to join the shaped packaging material web together at a packaging material overlap area in a direction of travel of the shaped packaging material web. The packaging apparatus further includes a transverse joining device configured to join the shaped packaging material web together at predetermined intervals transversely to the direction of travel to form a transverse joining area. The packaging apparatus also includes an embosser comprising a matrix of embossing pins that are individually moveable transversely to the direction of travel. The packaging apparatus further includes an embosser stop area, wherein the matrix of embossing pins and the embosser stop area are configured to form palpable elevations in the transverse joining area, the palpable elevations comprising a dot pattern in the shape of a Braille character.

The foregoing and other features, aspects and advantages of the disclosed embodiments will become more apparent from the following detailed description and accompanying drawings.

BRIEF DESCRIPTION OF THE DRAWINGS

One or more embodiments of the packaging apparatus according to the disclosure and of the method according to the disclosure is described below with reference to the drawings.

DETAILED DESCRIPTION

Figure 1A:
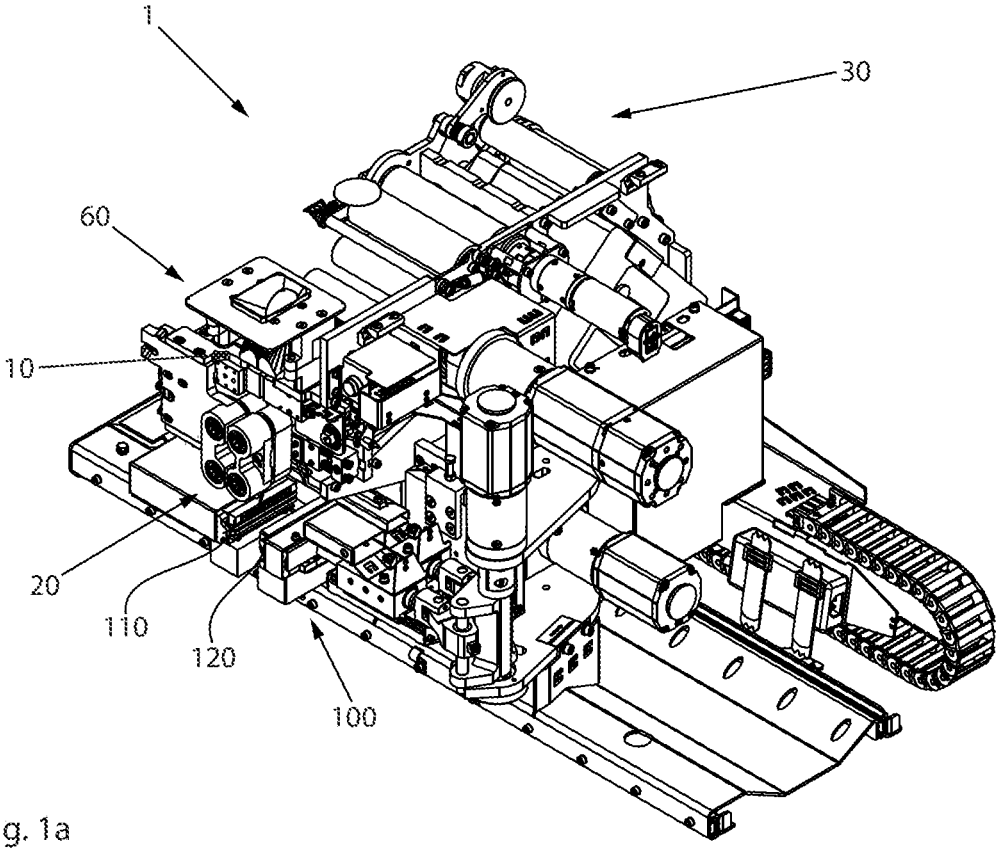
FIG. 1*a* is a perspective view of a packaging apparatus, according to aspects of the disclosure.

The detailed description set forth below describes various configurations of the subject technology and is not intended to represent the only configurations in which the subject technology may be practiced. The detailed description includes specific details for the purpose of providing a thorough understanding of the subject technology. Accordingly, dimensions are provided in regard to certain aspects as non-limiting examples. However, it will be apparent to those skilled in the art that the subject technology may be practiced without these specific details. In some instances, well-known structures and components are shown in block diagram form in order to avoid obscuring the concepts of the subject technology.

It is to be understood that the present disclosure includes examples of the subject technology and does not limit the scope of the appended claims. Various aspects of the subject technology will now be disclosed according to particular but non-limiting examples. Various embodiments described in the present disclosure may be carried out in different ways and variations, and in accordance with a desired application or implementation.

Apparatuses for blistering medicament portions, also known as blister machines, are known, for example, from WO 2013/034504 A1. Depending on the stage of expansion, the apparatuses comprise hundreds of supply and dispensing stations, in each of which a plurality of medicament portions of a certain type of drug are stored. Upon request, individual medicament portions can be dispensed from the supply and dispensing stations and fed to a packaging device via a guiding device, in which the medicament portions are packaged or blistered. Packaging devices for use in the blister machines mentioned above are known, for example, from WO 2016/113291 A1 and WO 2018/184795 A1.

In the case of the packaging apparatuses used in blister machines, blister tubes are usually produced which comprise a plurality of blister bags. To produce the blister bags or blister tubes, a packaging material web is shaped in such a way that one or more medicament portions can be fed to a receiving area. After the medicament portions to be blistered are fed to the receiving area, the individual blister bags of the blister tube are completed by joining together the packaging material web at predetermined locations, the blister bags extending like a strand over the blister tube.

The individual blister bags contain patient-specific medicament portions and/or food supplement portions. A patient is usually provided with a plurality of blister bags or a part of the blister tube, and the patient has to recognize from the intake information printed on a blister bag when the medicament composition contained in a blister bag has to be taken, for example in the morning, at noon, or in the evening. In known packaging apparatuses, the intake information intended for the patient is printed onto the packaging material web before the blister bag is joined together. Because of the small size of the blister bags themselves, the printed intake information for the patient is also kept relatively small, so that it can be difficult or impossible for a patient with a visual impairment to grasp, i.e. read, the information, without the use of certain aids.

It is an object of the present disclosure to provide a packaging apparatus for small piece goods, with which blister bags can be produced, the intake information of which can also be perceived by patients with a visual impairment. It is further an object of the present disclosure to provide a method for producing such blister bags.

The object is achieved on the one hand by a packaging apparatus for small piece goods according to aspects of the disclosure. Within the scope of the present disclosure, the term "small piece goods" is intended in particular to comprise medicament portions and food supplement portions in, for example, tablet form. However, the packaging apparatus can also be used to pack other small piece goods (for example, screws and the like).

The packaging apparatus for small piece goods according to the disclosure, with which blister bags can be produced having intake information perceivable by people with a visual impairment, comprises a packaging material guiding device for receiving an elongated packaging material web, the packaging material guiding device being designed such that the elongated packaging material web is shaped in such a way that it is suitable for receiving medicament portions (i.e. has a receiving area for small piece goods) and continues in a direction of travel. How exactly the elongated packaging material web entering the packaging material guiding device is shaped for receiving small piece goods depends on the manner in which the small piece goods to be packaged are fed, how the direction of travel of the formed packaging material web runs and whether the packaging material web is already pre-shaped, for example. For example, it is conceivable that the packaging material is fed already folded in the longitudinal direction or in the direction of travel.

If, for example, the packaging material web is moved vertically downward after the shaping, as described in WO 2018/184795 A1, the packaging material web is shaped in a tubular manner, the lower end of the tubular part being formed by a separating area into a leading, already formed blister bag. In such a case, the medicament portions (that is, the small piece goods) are routed directly from above into the receiving area formed with the folding and guiding device. If, alternatively, the direction of travel is more oblique, as described in WO 2016/113291 A1, the packaging material web is shaped into a kind of tetrahedron open at the top, which forms the receiving area for the medicament portions. The exact structural design of the packaging material guiding device is not substantial for the disclosure as long as the function described above is fulfilled by it.

The packaging apparatus according to aspects of the disclosure further comprises a longitudinal joining device downstream of the packaging material guiding device, which joins the packaging material web at a packaging material overlap area in the direction of travel of the packaging material web. This packaging material overlap area can be predetermined by a special structural design of the packaging material guiding device.

A transverse joining device is also arranged downstream of the packaging material guiding device and joins the packaging material web together at predetermined intervals (in relation to the longitudinal axis or direction of travel of the packaging material web) transversely to the direction of travel to a transverse joining area, the transverse joining device comprising two joiners, at least one of which can be moved transversely to the direction of travel. This transverse joining area can correspond to the upper separating part between two blister bags. This is the case when the blister tube (as is customary) is produced in such a way that the transverse joining area is assigned to two successive blister bags, between which, for example, a perforation is provided within the transverse joining area to separate the individual blister bags. Alternatively, the blister tube can also be produced in such a way that each blister bag is assigned two "separate" transverse joining areas. The longitudinal joining device and the transverse joining device can be arranged one behind the other in the direction of travel as separate components (the transverse joining device being arranged regularly downstream of the longitudinal joining device), but it is also conceivable that the two joining devices are arranged in a common joining component.

The packaging apparatus also comprises, according to aspects of the disclosure, a plurality of embossers which can be moved individually transversely to the longitudinal direction and an embosser stop area, the embossers and the embosser stop area cooperating in such a way that elevations which are palpable can be formed by the embossers in the transverse joining area.

By forming palpable elevations in the transverse joining area, it is also possible for a patient with a visual impairment to differentiate between a plurality of blister bags. If, for example, three blister bags are provided to a patient per day, it is possible when using two embossing pins to mark the three blister bags with a pattern such that the patient can unequivocally assign them to a time of intake. The packaging device according to the disclosure thus makes it possible to provide blister bags which can also be clearly assigned to a predetermined time of intake by a patient with a visual impairment.

How exactly the embossers are realized in the packaging apparatus is not substantial for the present disclosure, as long as it is ensured that the palpable elevations are introduced into the transverse joining area. For example, it is conceivable to provide a further device downstream of the joining devices, which device comprises the embossers and by which the palpable elevations are introduced into the transverse joining areas. However, in order to avoid the use of a separate device for guiding the embossers, it is provided in one or more embodiments of the packaging apparatus according to the disclosure that the embossers are arranged so that they can be extended and retracted in one of the joiners and that the other joiners have an elastically designed joining surface at least in one contact area or a plurality of embossers receptacles which are individually movable transversely to the direction of travel. In aspects of the disclosure, the palpable elevations are thus generated simultaneously with the production of the transverse joining area, so that it is not necessary to introduce the palpable elevations with a separate device after the transverse joining area has been created, which reduces or keeps low the complexity and the overall length (in the direction of travel) of the packaging apparatus.

Even when two embossers are used, it is possible to clearly identify the blister bags in such a way that a patient can differentiate between four different blister bags, making it possible for a patient with visual impairment to be able to differentiate the blister bags of a daily requirement without help. In order to clearly differentiate a large number of blister bags from one another and to simplify the determination of the information provided by the elevations, it is provided in one or more embodiments of the packaging apparatus according to the disclosure that the embossers are formed of at least one 2 by 3 matrix (horizontal, vertical) of embossing pins so that a dot pattern in the shape of a Braille character can be generated per matrix by the embossing pins. Even if only one matrix is used, 64 different patterns can be displayed, so that in such a case blister bags can be clearly distinguished from one another for a whole week, for example. When using larger and/or a plurality of matrices, it is therefore possible to emboss a large number of data in the transverse joining area.

The blister bags can be joined in different ways from the elongated packaging material web. For example, certain areas can be provided with an adhesive prior to joining. In one or more embodiments, however, it is provided that at least one joining surface of a joiner can be heated, so that the joining together takes place as a welding of the packaging material.

As already indicated above, the packaging material guiding device can be realized differently depending on the overall construction of the packaging apparatus. In one or more embodiments, the packaging material guiding device comprises a central through opening and is designed such that the elongated packaging material web is fed to the through opening, which is realized such that the elongated packaging material web is shaped in the direction of travel to a tubular packaging material web defined by the through opening and having a packaging material web overlap area, wherein a guide part of a guiding device for medicament portions extends within a part of the tubular packaging material web, which ends in the delivery area of the tubular packaging material web. In order to ensure in a tubular-shaped packaging material web that the transverse joining by the transverse joining device without overlapping of the packaging material web takes place without errors in the transverse joining area, it is provided in aspects of the disclosure that a plurality of spreaders are arranged in the lower area of the guide part which spread open the tubular packaging material web for joining by the transverse joining device in accordance with the alignment of the joiners. In other words, the spreaders ensure that the tubular packaging material web is adapted to the alignment of the joiners before being joined, i.e. is converted from the circular shape into an elongated shape, which can be better joined together by the transverse joining device.

The application also relates to the use of a packaging apparatus according to aspects of the disclosure for producing a blister tube comprising a plurality of blister bags.

In the method according to the disclosure for producing a blister tube comprising a plurality of blister bags, an elongated packaging material web is first provided, which is then shaped into a receiving area by a packaging material guiding device for receiving medicament portions. Exactly how this shaping is carried out depends on the exact design of the packaging material guiding device, the direction of travel of the packaging material web and the exact design of the packaging material, as discussed above. After shaping for receiving small piece goods, small piece goods are fed to the receiving area and the packaging material web is joined together to form a tubular packaging material web with a longitudinal joining device in a packaging material overlap area in the direction of travel of the packaging material web, wherein the joining together and feeding of small piece goods can also take place simultaneously or in reverse order. With the transverse joining device, the tubular packaging material web is joined at predetermined intervals, based on the direction of travel or longitudinal axis of the packaging material web, in a transverse joining area, which can also take place simultaneously with the joining in the longitudinal direction. According to the disclosure, a palpable pattern is embossed in the transverse joining area by a plurality of embossers which can be moved transversely to the direction of travel.

In one or more embodiments of the method according to the disclosure, the embossers are designed as at least one 2 by 3 matrix of embossing pins, so that a dot pattern in the shape of a Braille character can be embossed into the transverse joining area per matrix by the embossing pins. In this way, a large amount of information can be introduced by palpable characters that are known to a large number of patients with visual impairments.

In order to support the joining together of the pre-shaped packaging material web with the transverse joining device and to reduce the likelihood of joining errors, it is provided in one or more embodiments of the method that the tubular packaging material web is spread open by a plurality of spreaders before the joining.

Figure 1B:
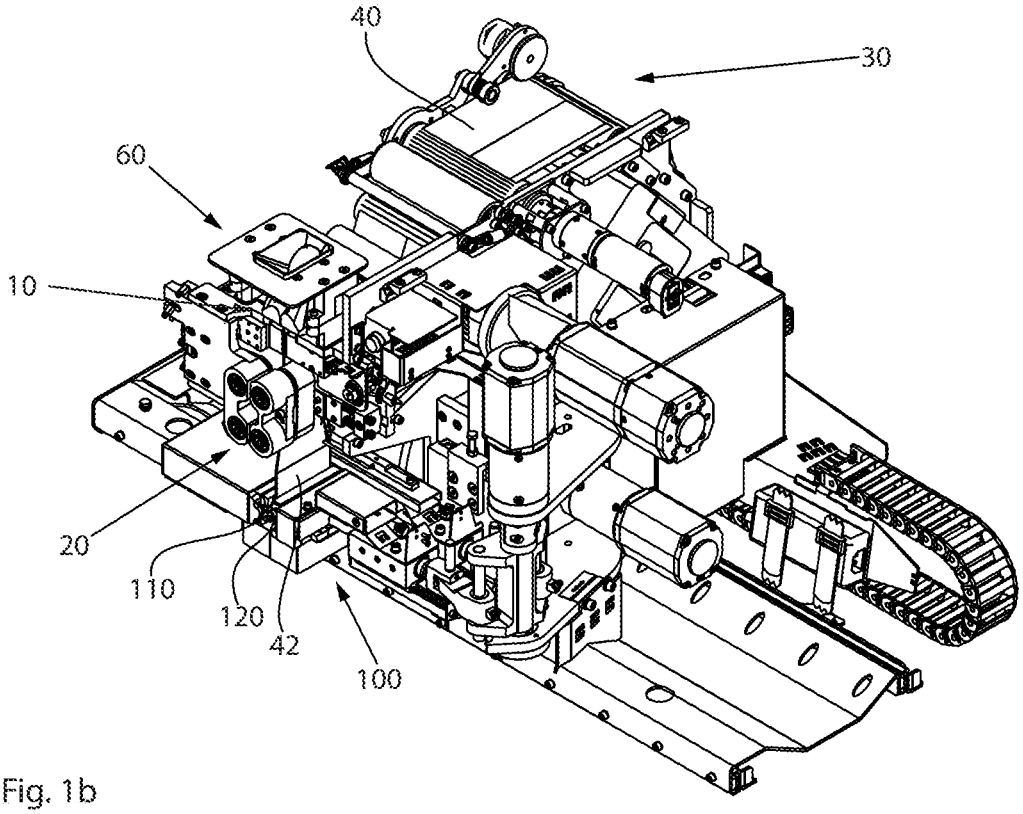
FIG. 1*b* is a perspective view of the packaging apparatus of FIG. 1*a* with a packaging material web, according to aspects of the disclosure.

In aspects of the disclosure, a specially designed packaging material guiding device is described which is suitable for a not pre-shaped (pre-folded) packaging material web. In the following detailed description, medicament portions are provided as small piece goods. FIGS. 1*a* and 1*b* show oblique views of one or more embodiments of the packaging apparatus 1 according to the disclosure, a packaging material web 40 extending through the packaging apparatus 1 being omitted in FIG. 1*a* in order to illustrate the components located underneath. In the packaging apparatus 1 described below, a blister tube is produced in which two successive blister bags "share" a transverse joining area. This means that the embossers are arranged accordingly, either in such a way that the patterns are only created in a part of the transverse joining area, this part being assigned to a blister bag. In some aspects of the disclosure, the embossers can be arranged in such a way that patterns are embossed in both parts of the transverse joining area, which patterns are then each assigned to a blister bag.

The embodiment of the packaging apparatus 1 shown comprises a packaging material feed 30, by which the elongated packaging material web 40 is fed to a packaging material guiding device 10 via a plurality of rollers, the path of the packaging material web 40 being shown only partly in FIG. 1*b*. Above the packaging material guiding device 10, which is described in more detail in the following figures, a medicament guiding device 60 is arranged, by which provided medicament portions are fed to a receiving area for medicament portions, which is formed by a shaped area 43 (e.g., tubular shape) of the packaging material web 40. In the packaging apparatus 1 shown, the shaped packaging material web 43 is guided vertically downward from the packaging material guiding device 10, as can be seen in more detail in the following figures. Due to the vertical guidance of the packaging material web 40, the direction of travel thereof is determined as "downwards." In the case of different designs of the medicament guiding device 60 and the packaging material guiding device 10, the direction of travel can also be different. For example it is conceivable that the direction of travel runs obliquely, in which case the receiving area for the medicament portions is shaped differently (see also WO 2016/113291 A1 and WO 2018/184795 A1 for details).

A longitudinal joining device 20 is arranged downstream of the packaging material guiding device 10, with which an overlapping area 41 of the shaped packaging material web 43 extending in the direction of travel is joined, as is described in more detail with reference to the following figures.

Downstream of this longitudinal joining device 20, a transverse joining device 100 is arranged, which comprises two joiners 110, 120, wherein as shown the joiners 120 can be moved transversely or orthogonally to the direction of travel of the packaging material web 40, as already indicated in FIG. 1*b*, in which the two joiners 110, 120 are brought together for producing a transverse joining area 42 of the packaging material web 40. The above-mentioned devices of the packaging apparatus 1 according to the disclosure comprise a plurality of drives, as can be seen in part in FIGS. 1*a* and 1*b*, the exact mode of operation and arrangement within the packaging apparatus 1 are, however, not substantial for the disclosure. These are usually rotary motors, the mode of operation of which need not be described in more detail here.

Figure 2B:
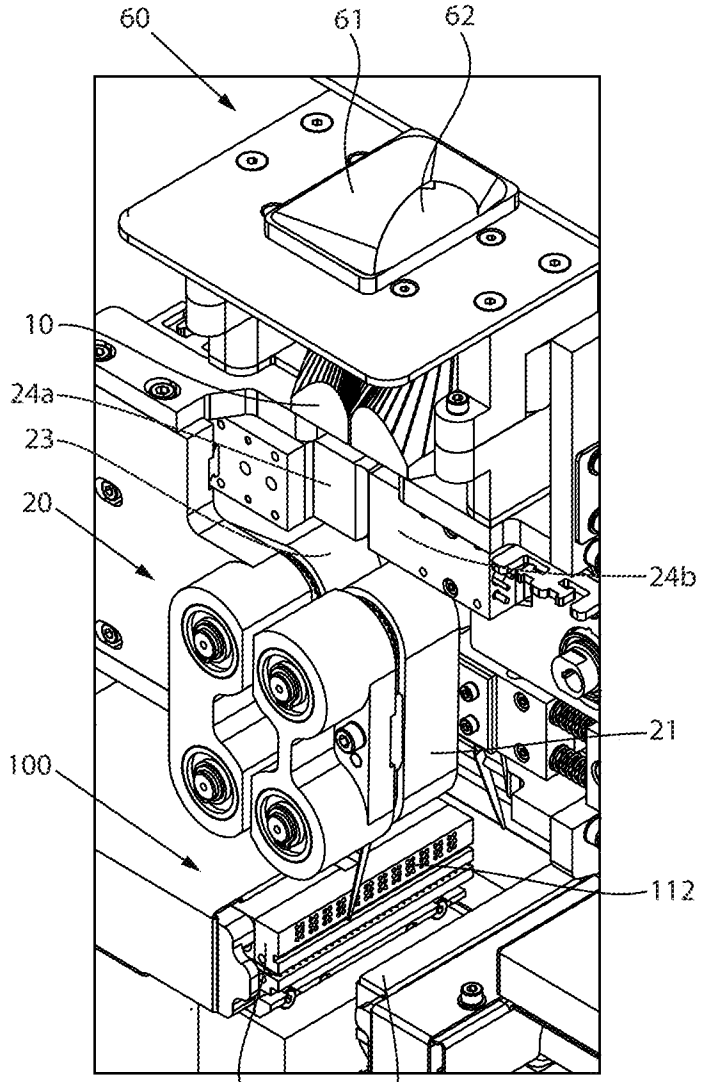
FIG. 2*b* is a perspective view of the longitudinal and transverse joining devices of FIG. 2*a* with the packaging material web removed, according to aspects of the disclosure.
Figure 2A:
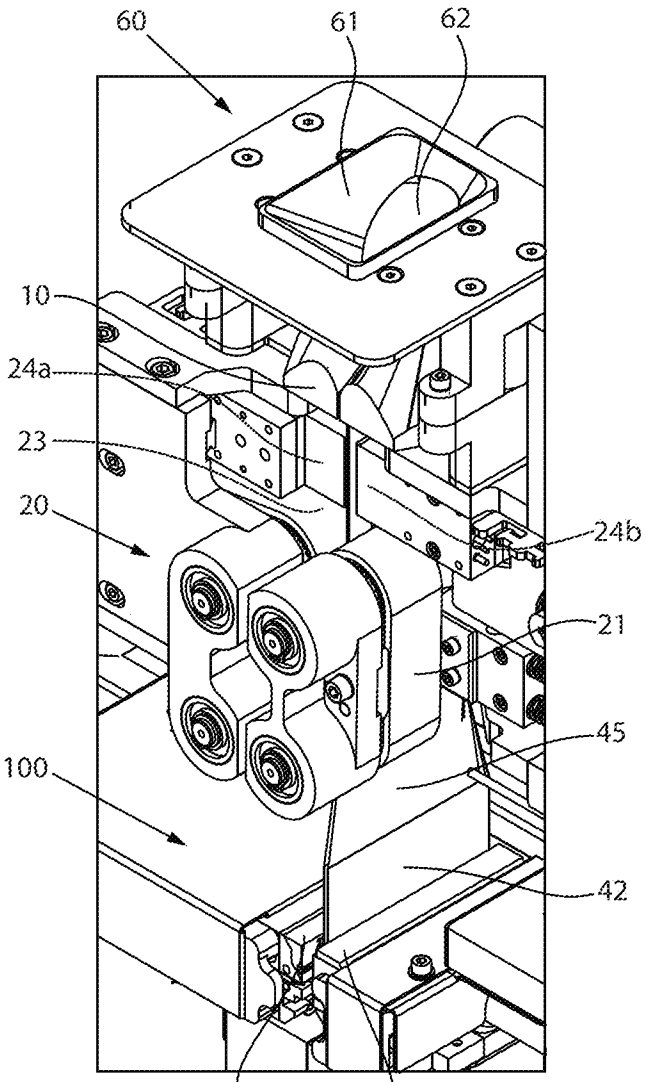
FIG. 2*a* is a perspective view of longitudinal and transverse joining devices, according to aspects of the disclosure.

FIGS. 2*a* and 2*b* show detailed views of the packaging apparatus 1, in particular the medicament guiding device 60, the packaging material guiding device 10, the longitudinal joining device 20, and the transverse joining device 100. Arranged above the packaging material guiding device 10, which is only indicated in FIGS. 2*a* and 2*b*, is a medicament guiding device 60 which comprises a funnel-shaped receiving area 61 for receiving medicament portions. The receiving area 61 guides the medicament portions into a guide part 62, with which the medicament portions are guided into a receiving area 45 of the shaped packaging material web 43, as is described in more detail with reference to FIGS. 3*a* and 3*b*. The longitudinal joining device 20 is arranged downstream (in relation to the direction of travel of the packaging material web 40) of the packaging material guiding device 10. This substantially comprises two assemblies, namely a connecting assembly having two welding jaws 24*a*, 24*b* and a movement assembly arranged downstream of this connecting assembly, which moves the overlapping area joined by the welding jaws 24*a*, 24*b* "downwards" in the direction of travel by belt drives 21, 23 (e.g., conveyors). In one or more embodiments, it is conceivable that, instead of the welding jaws 24*a*, 24*b*, the overlapping area is acted on, for example, with an adhesive before being joined, and this area is then only pressed together and no welding takes place by heat. Downstream of the longitudinal joining device 20, the transverse joining device 100 is arranged, by which the packaging material web 40, which has already been welded in the longitudinal direction, is joined in the transverse direction, as a result of which a transverse joining area 42 (shown here in an exaggerated manner) is created.

Figure 3B:
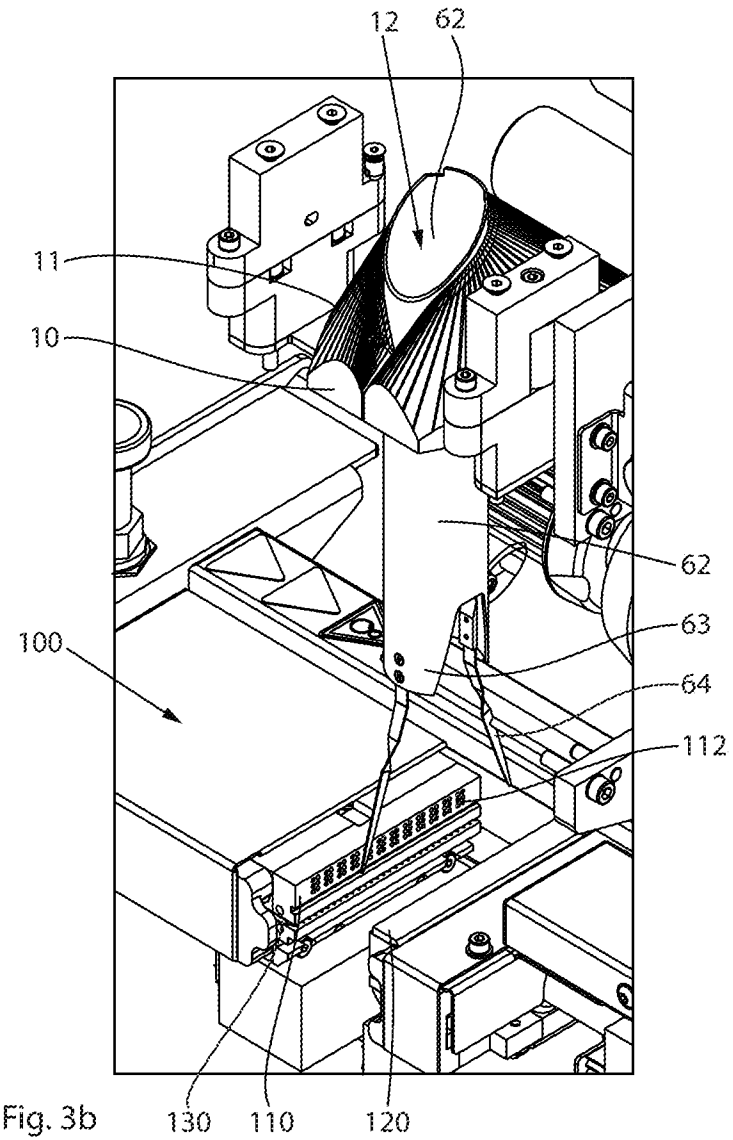
FIG. 3*b* is a perspective view of the folding and joining device of FIG. 3*a* with the packaging material web removed, according to aspects of the disclosure.
Figure 3A:
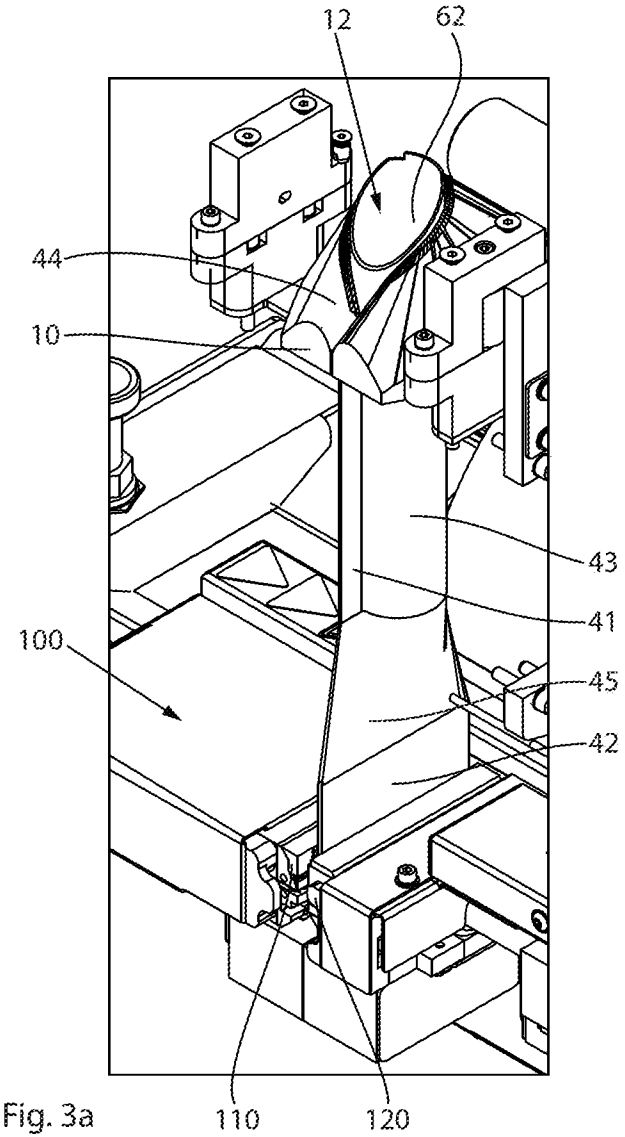
FIG. 3*a* is a perspective view of a folding and joining device, according to aspects of the disclosure.

FIGS. 3*a* and 3*b* show further detailed views, the medicament guiding device 60 being partially omitted and the longitudinal joining device 20 being completely omitted. In addition, the packaging material web 40 is omitted in FIG. 3*b*. In FIG. 3*a* in particular the travel and the shaping of the packaging material web 40 within the packaging apparatus 1 according to the disclosure can be seen. From the packaging material feed 30 (not shown), the elongated packaging material web 40 reaches a receiving area 11 (to be seen in FIG. 3*b*) of the packaging material guiding device 10, which has a central through opening 12, towards which the packaging material web 40 is shaped. For this purpose, the packaging material guiding device 10 as shown is designed in a shoulder-shaped or collar-shaped manner having the central through opening 12. Due to the exact design of the packaging material guiding device 10, the elongated packaging material web 40 is formed over the shoulder-shaped receiving area 11 to form a tubular packaging material web 43 having a packaging material overlap area 41. In FIG. 3*a* it can be seen that the packaging material web 40 is guided over the receiving area 11 and is shaped accordingly (reference numeral 44 shows the packaging material web 40 resting on the receiving area 11).

The packaging material overlap area 41 is first welded by the welding jaws 24*a*, 24*b* shown in FIGS. 2*a* and 2*b* and then moved further in the direction of travel (that is, downwards as shown) by the conveyers 21, 23. In order to ensure that the shape of the packaging material web 40 predetermined by the packaging material guiding device 10 with its central through opening 12, is maintained, namely in a tubular form, the guide part 62 of the medicament guiding device 60 is guided in order to support this area. The exact arrangement of this guide part 62 can be seen in FIG. 3*b*. A comparison of FIGS. 3*a* and 3*b* also shows that the packaging material web 40 in the area of the packaging material guiding device 10 extends through a gap between the guide part 62 and the wall of the central through opening 12. Then, the tubular packaging material web 43 is guided further, on the outside on the guide part 62.

As can be seen in FIGS. 3*a* and 3*b*, the tubular packaging material web 43 is spread open to the receiving area 45 by spreaders 64, which are secured in the lower area 63 of the guide part 62. The medicament portions to be blistered arrive in this receiving area 45. Because of the already introduced transverse joining area 42 of the leading blister bag, the receiving area 45 is also closed at the bottom. The use of the spreaders 64 is not absolutely necessary, but the use thereof ensures an error-free and visually appealing joining together of the transverse joining area 42.

With regard to a possible design of the packaging material guiding device 10 as well as the medicament guiding device 60 and the longitudinal joining device 20, reference is also made to the application WO 2018/184795 A1, the relevant disclosure content of which is hereby incorporated into this application for the aforementioned devices.

Figure 4A:
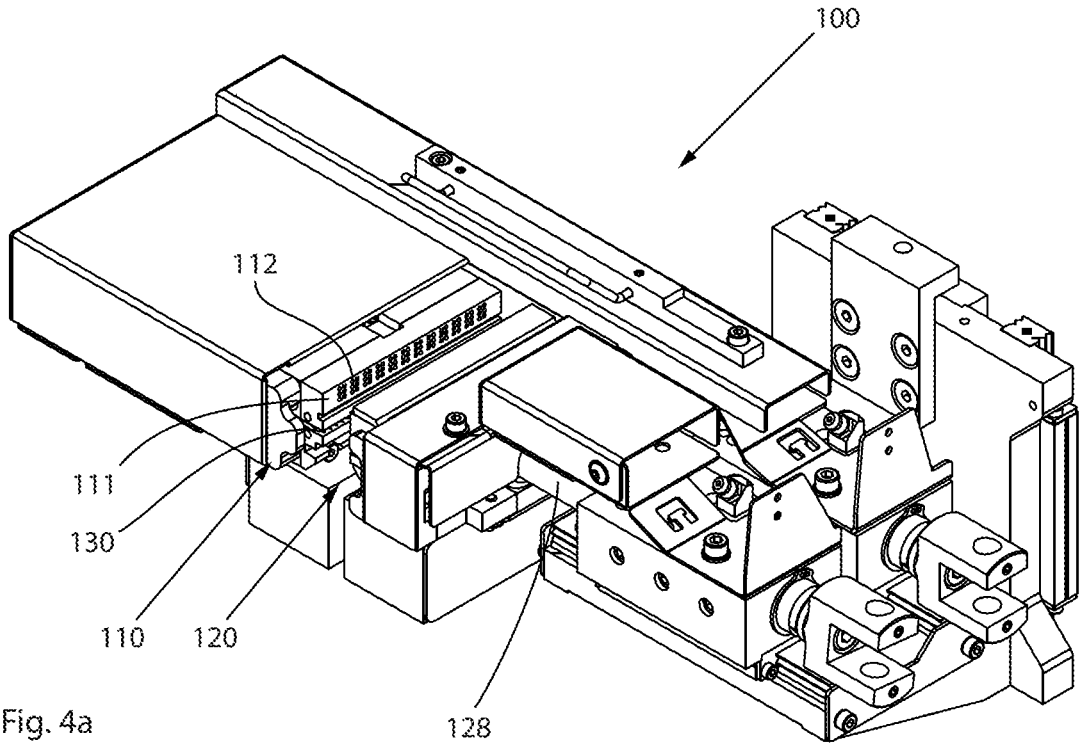
FIG. 4*a* is a perspective view of a transverse joining device, according to aspects of the disclosure.
Figure 4B:
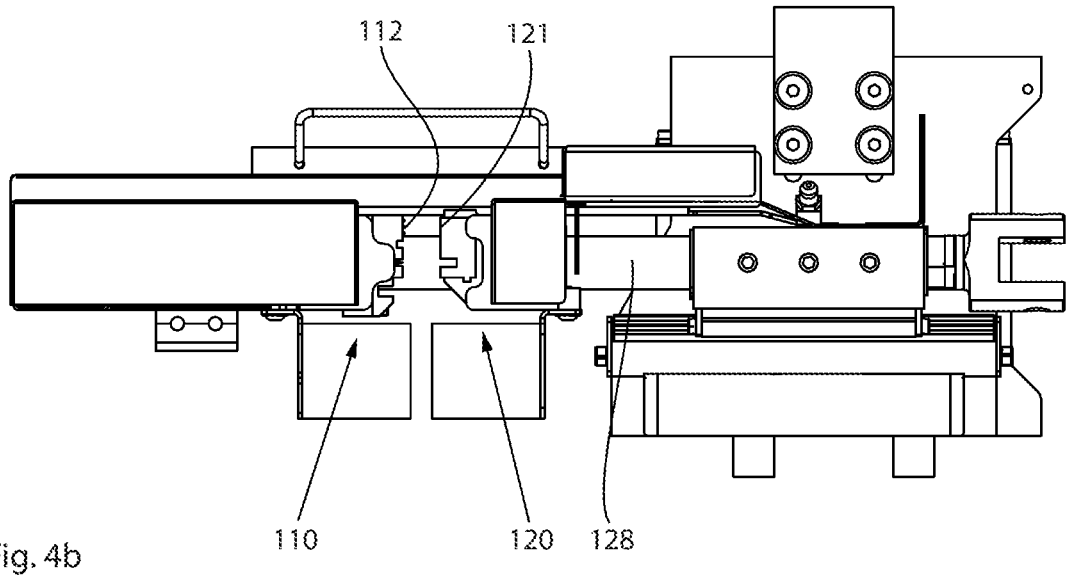
FIG. 4*b* is a front view of the transverse joining device of FIG. 4*a*, according to aspects of the disclosure.

FIGS. 4*a* and 4*b* show detailed views of the transverse joining device 100 having the two joiners 110 and 120. In FIG. 4*a* it can be seen that in one or more embodiments of the packaging apparatus 1 according to the disclosure shown here, the embossers 112 are arranged in the joiners 110, specifically in such a way that the embossers 112 designed as embossing pins can be extended and retracted with respect to a surface 111 of the joiners 110. As shown here, only the joiners 120 can be moved horizontally, that is to say transversely or orthogonally to the direction of travel of the packaging material web 40, for which purpose a merely indicated horizontal movement device 128 is provided as shown, the more exact mode of operation of which is not relevant here.

In order that a palpable pattern can be introduced into the transverse joining area 42 by the extendable and retractable embossing pins 112, the embossing pins 112 cooperate with an elastically designed stop area 121 which is formed in the joiners 120.

Figure 5A:
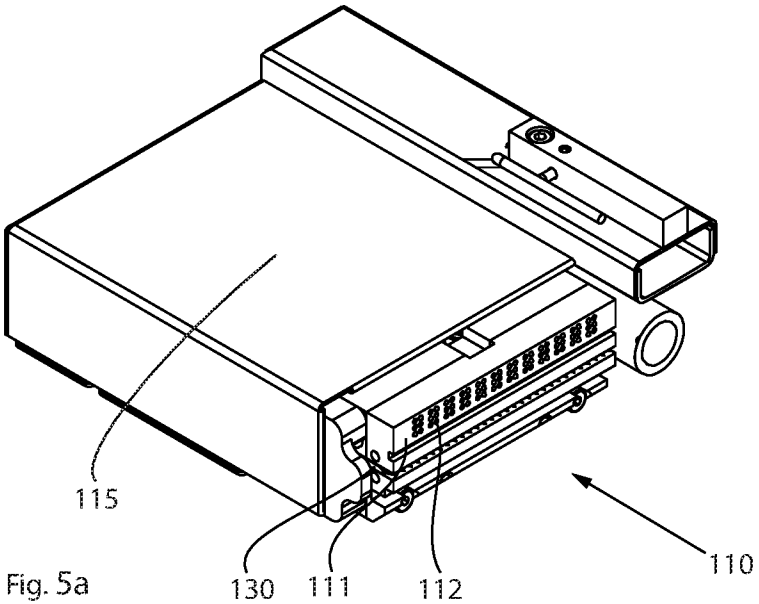
FIG. 5*a* is a cross-sectional perspective view of the transverse joining device of FIG. 4*a*, according to aspects of the disclosure.
Figure 5B:
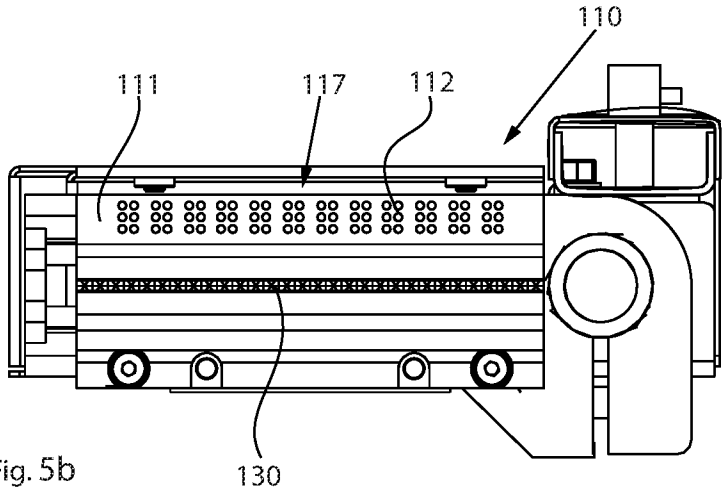
FIG. 5*b* is a side view of the transverse joining device of FIG. 5*a*, according to aspects of the disclosure.

FIGS. 5*a* and 5*b* show detailed views of the joiners 110, which is arranged in a bracket 116 (shown in FIG. 6*a*) on or in a joiner housing 115. As can be seen in particular in FIG. 5*b*, the embossers 112 are designed as twelve 2 by 3 matrices 117, so that twelve Braille characters can be introduced into the transverse joining area 42 with the joiners 110 shown. In order to simplify the separation of the individual blister bags, a separator 130 is provided below the joiners 120, which can be moved horizontally, that is to say transversely or orthogonally to the direction of travel of the packaging material band, and can introduce a perforation into the transverse joining area 42 or can completely separate it.

Figure 6A:
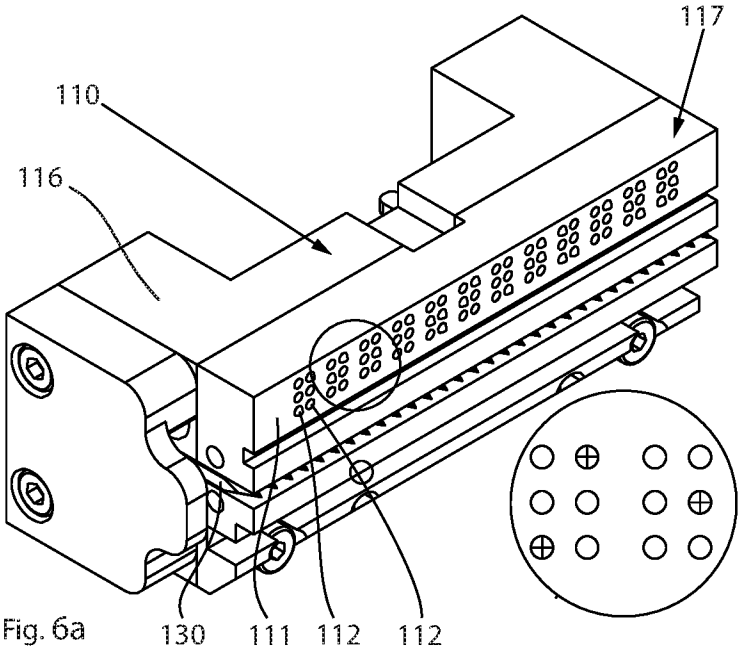
FIG. 6*a* is a perspective view of a joiner, according to aspects of the disclosure.
Figure 6B:
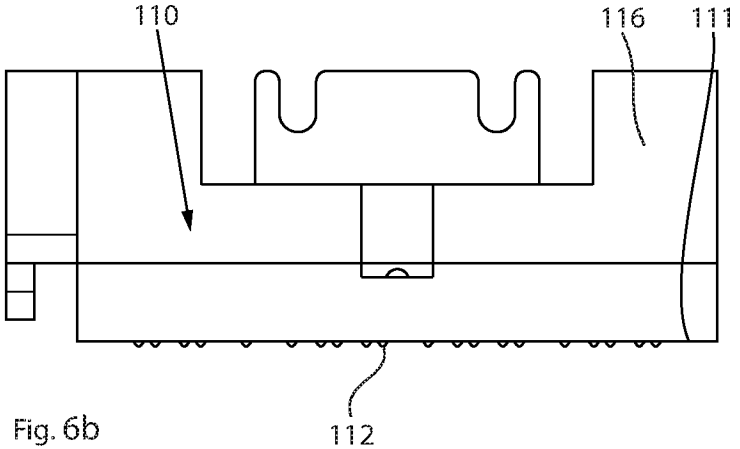
FIG. 6*b* is a top view of the joiner of FIG. 6*a*, according to aspects of the disclosure.

FIGS. 6*a* and 6*b* show detailed views of the joiners 110, and in FIGS. 6*a* and 6*b* it can be seen to some extent that the individual embossers 112 designed as embossing pins are individually movable in and out. FIGS. 6*a* and 6*b* illustrate the same position of the embossing pins 112, and two 2 by 3 matrices are highlighted on the basis of the detailed image, the lower embossing pin of the first column and the upper embossing pin 112 of the second column being extended in the highlighted matrix on the left, whereas in the second matrix, only the middle embossing pin 112 in the second column is extended. How exactly the individual embossing pins 112 are moved is not substantial to the present disclosure and is known to the person skilled in the art, for example from conventional apparatuses for writing in Braille.

Figure 7:
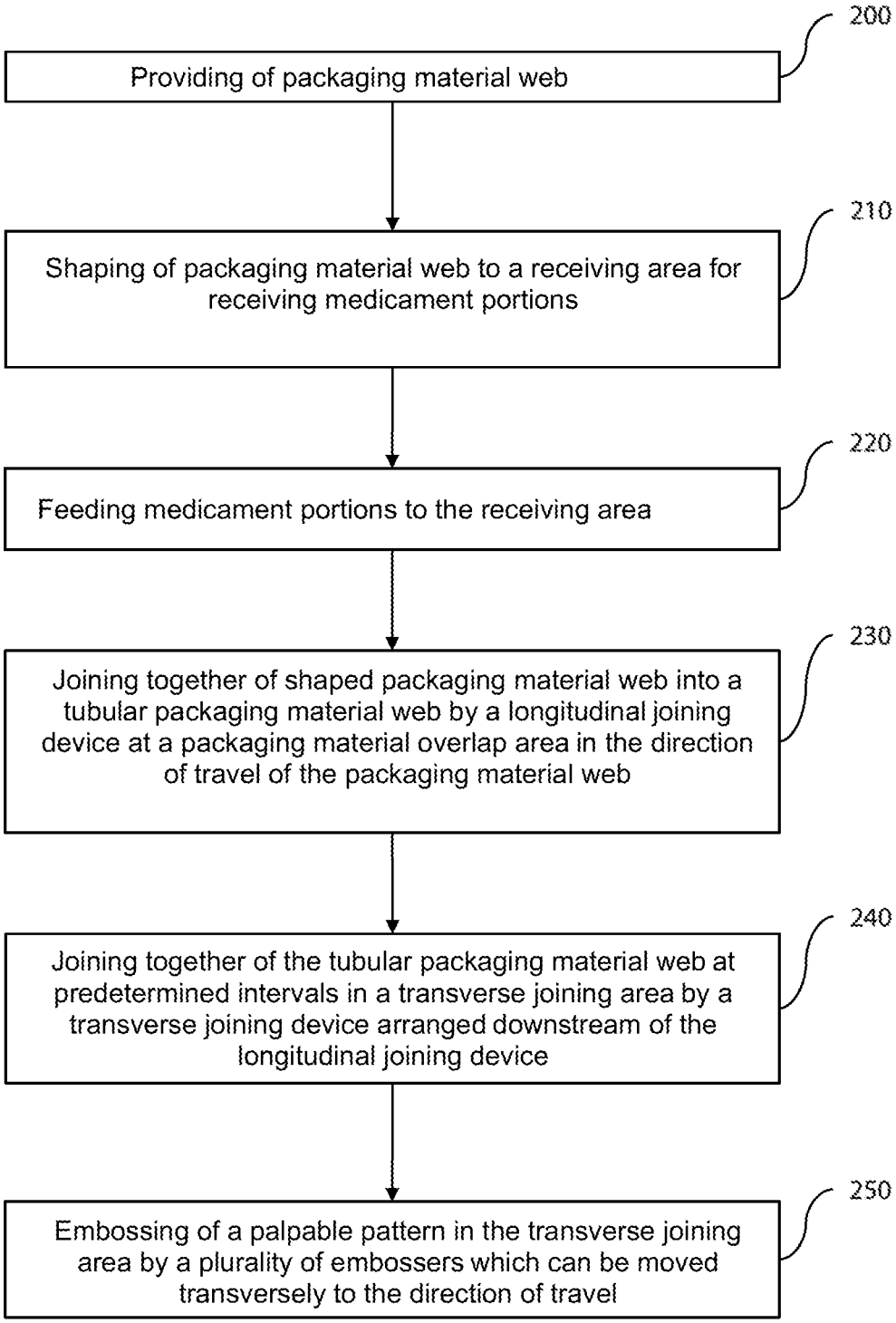
FIG. 7 is a flow chart of a method for producing a blister tube comprising a plurality of blister bags.

FIG. 7 shows a flow chart of one or more embodiments of the method according to the disclosure. In one or more embodiments of the method described below, a blister tube is produced in which two successive blister bags "share" a transverse joining area 42. This means that the embossers 112 are arranged accordingly, either in such a way that the patterns are only created in a part of the transverse joining area 42, this part being assigned to a blister bag. Alternatively, the embossers 112 can be arranged in such a way that patterns can be embossed in both parts of the transverse joining area 42, which patterns are then each assigned to a blister bag.

First, a packaging material web 40 is provided in a step 200, which, in a step 210, is shaped into a receiving area 45 for receiving medicament portions. This is done, for example, with the packaging material guiding device 10 described in the previous figures. After the receiving area 45 has been formed, the medicament portions to be blistered are fed to it in a step 220. In a step 230, the shaped packaging material web 43 is joined (e.g., welded) with the longitudinal joining device 20 at a packaging material overlap area 41 in the direction of travel of the packaging material web 40 to form a tubular packaging material web 43. In a subsequent step 240, the tubular packaging material web 43 is joined at predetermined intervals in or to a transverse joining area 42 with a transverse joining device 100 arranged downstream of the longitudinal joining device 20. When viewed in the direction of travel, this transverse joining area 42 is the end of the blister bag that has just been processed and at the same time the "lower" end of a new subsequent blister bag, the transverse joining area 42 forming a part of the receiving area 45 of the following blister bag. According to aspects of the disclosure, a palpable pattern is embossed in step 250 in the transverse joining area 42 by a plurality of embossers 112 which can be moved transversely to the direction of travel, the arrangement in the transverse joining area 42 being such that the patterns are assigned to one or both blister bags. In one or more embodiments of the apparatus and the method described here, the pattern is only assigned to one blister bag; when using joiners having more complex embossers, patterns for both blister bags can also be embossed in the transverse joining area 42, which "share" the transverse joining area 42 (as the upper or lower end of the blister bags, regularly separated by a perforation made with a separator 130).

The present disclosure is provided to enable any person skilled in the art to practice the various aspects described herein. The disclosure provides various examples of the subject technology, and the subject technology is not limited to these examples. Various modifications to these aspects will be readily apparent to those skilled in the art, and the generic principles defined herein may be applied to other aspects.

A reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject technology.

The word "exemplary" or the term "for example" is used herein to mean "serving as an example or illustration." Any aspect or design described herein as "exemplary" or "for example" is not necessarily to be construed as preferred or advantageous over other aspects or designs. In one aspect, various alternative configurations and operations described herein may be considered to be at least equivalent.

As used herein, the phrase "at least one of" preceding a series of items, with the term "or" to separate any of the items, modifies the list as a whole, rather than each item of the list. The phrase "at least one of" does not require selection of at least one item; rather, the phrase allows a meaning that includes at least one of any one of the items, and/or at least one of any combination of the items, and/or at least one of each of the items. By way of example, the phrase "at least one of A, B, or C" may refer to: only A, only B, or only C; or any combination of A, B, and C.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

In one aspect, unless otherwise stated, all measurements, values, ratings, positions, magnitudes, sizes, and other specifications that are set forth in this specification, including in the claims that follow, are approximate, not exact. In one aspect, they are intended to have a reasonable range that is consistent with the functions to which they relate and with what is customary in the art to which they pertain.

It is understood that the specific order or hierarchy of steps, operations or processes disclosed is an illustration of exemplary approaches. Based upon design preferences, it is understood that the specific order or hierarchy of steps, operations or processes may be rearranged. Some of the steps, operations or processes may be performed simultaneously. Some or all of the steps, operations, or processes may be performed automatically, without the intervention of a user. The accompanying method claims, if any, present elements of the various steps, operations or processes in a sample order, and are not meant to be limited to the specific order or hierarchy presented.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112 (f) unless the element is expressly recited using the phrase "means for" or, in the case of a method claim, the element is recited using the phrase "step for." Furthermore, to the extent that the term "include," "have," or the like is used, such term is intended to be inclusive in a manner similar to the term "comprise" as "comprise" is interpreted when employed as a transitional word in a claim.

The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way.

What is claimed:

1. A packaging apparatus for small piece goods, comprising:

a packaging material guiding device for receiving an elongated packaging material web, wherein the packaging material guiding device is configured such that the elongated packaging material web is shaped to be suitable for receiving small piece goods and wherein the elongated packaging material web shape continues in a direction of travel;

a longitudinal joining device arranged downstream of the packaging material guiding device and configured to join the shaped packaging material web together at a packaging material overlap area in the direction of travel of the shaped packaging material web;

a transverse joining device which is arranged downstream of the packaging material guiding device and configured to join the shaped packaging material web together at predetermined intervals transversely to the direction of travel to form a transverse joining area, wherein the transverse joining device comprises two joiners, wherein at least one joiner is movable transversely to the direction of travel;

a plurality of embossers that are individually moveable transversely to the direction of travel; and an embosser stop area, wherein the plurality of embossers and the embosser stop area cooperate to form elevations that are palpable in the transverse joining area.

2. The packaging apparatus of claim 1, wherein the embossers are arranged so that they can be extended and retracted in one of the joiners, and wherein the other joiner has, at least in one contact area, an elastically designed joining surface.

3. The packaging apparatus of claim 1, wherein the embossers are arranged so that they can be extended and retracted in one of the joiners, and wherein the other joiner has, at least in one contact area, a plurality of embosser receptacles that are individually movable transversely to the direction of travel.

4. The packaging apparatus of claim 1, wherein the embossers are configured as at least one 2 by 3 matrix of embossing pins, wherein a palpable dot pattern in the shape of a Braille character is generated per matrix by the embossing pins.

5. The packaging apparatus of claim 1, wherein at least one joining surface of a joiner can be heated.

6. The packaging apparatus of claim 1, wherein the packaging material guiding device has a central through opening and is configured such that the elongated packaging material web is fed to the central through opening, wherein the elongated packaging material web is shaped in the direction of travel to a tubular packaging material web defined by the central through opening.

7. The packaging apparatus of claim 6, wherein the central through opening shapes the tubular packaging material web to have a packaging material overlap area.

8. The packaging apparatus of claim 6, wherein a guide part extends within a part of the tubular packaging material web.

9. The packaging apparatus of claim 8, wherein the guide part is positioned so that the packaging material web in the area of the packaging material guiding device extends through a gap between the guide part and a wall of the central through opening.

10. The packaging apparatus of claim 8, further comprising a plurality of spreaders arranged in the lower area of the guide part, the plurality of spreaders configured to spread open the tubular packaging material web to form a receiving area for medicament portions.

11. The packaging apparatus of claim 10, wherein the plurality of spreaders are configured to prepare the tubular packaging material web to be joined together by the transverse joining device according to an alignment of the joiners.

12. The packaging apparatus of claim 1, wherein the packaging apparatus is configured to produce a blister tube comprising a plurality of blister bags.

13. The packaging apparatus of claim 1, further comprising a separator arranged below the joiners, the separator moveable transversely to the direction of travel of the shaped packaging material web, wherein the separator is configured to introduce one of a perforation into the transverse joining area and a complete separation of the transverse joining area.

14. The packaging apparatus of claim 1, further comprising a medicament guiding device disposed above the packaging material guiding device, the medicament guiding device comprising a funnel-shaped receiving area configured to receive medicament portions.

15. A method for producing a blister tube comprising a plurality of blister bags, the method comprising:

providing a packaging material web in a direction of travel;

shaping, in the direction of travel, the packaging material web into a shaped packaging material web having a receiving area for medicament portions;

feeding small piece goods to the receiving area;

joining, by a longitudinal joining device, the shaped packaging material web together to form a tubular packaging material web at a packaging material overlap area in the direction of travel of the shaped packaging material web;

joining, by a transverse joining device, the tubular packaging material web together in a transverse joining area at predetermined intervals, based on the direction of travel; and embossing a palpable pattern in the transverse joining area by a plurality of embossers movable transversely to the direction of travel.

16. The method of claim 15, wherein the plurality of embossers are configured as at least one 2 by 3 matrix of embossing pins.

17. The method of claim 15, wherein the palpable pattern comprises a dot pattern in the shape of a Braille character.

18. The method of claim 15, further comprising spreading open, by a plurality of spreaders, the tubular packaging material web before joining the tubular packaging material web together in the transverse joining area at the predetermined intervals.

19. The method of claim 15, further comprising introducing, by a separator, one of a perforation into the transverse joining area and a complete separation of the transverse joining area.

20. A packaging apparatus, comprising:

a packaging material guiding device configured to shape a moving elongated packaging material web into a shaped packaging material web;

a longitudinal joining device configured to join the shaped packaging material web together at a packaging material overlap area in a direction of travel of the shaped packaging material web;

a transverse joining device configured to join the shaped packaging material web together at predetermined intervals transversely to the direction of travel to form a transverse joining area;

an embosser comprising a matrix of embossing pins that are individually moveable transversely to the direction of travel; and an embosser stop area, wherein the matrix of embossing pins and the embosser stop area are configured to form palpable elevations in the transverse joining area, the palpable elevations comprising a dot pattern in the shape of a Braille character.

* * * * *